US005138391A

United States Patent [19]

Takahashi et al.

[11] Patent Number: 5,138,391

[45] Date of Patent: Aug. 11, 1992

[54] IMAGE FIXING MEANS INCLUDING A SHEET SEPARATING DEVICE WHICH PREVENTS WEAR OF THE HEATING ROLLER

[75] Inventors: Tomohiko Takahashi; Hidetoshi Aoki, both of Yokohama, Japan

[73] Assignee: Kabushiki Kaisha Toshiba, Kawasaki, Japan

[21] Appl. No.: 623,494

[22] Filed: Dec. 7, 1990

[30] Foreign Application Priority Data

Dec. 7, 1989 [JP] Japan ..... 1-316369

[51] Int. Cl.[5] ..... G03G 15/20

[52] U.S. Cl. ..... 355/283; 271/313; 355/290; 355/315; 15/256.5

[58] Field of Search ..... 355/282, 283, 285, 290, 355/289, 295, 315; 271/312, 313, 900; 15/256.1

[56] References Cited

U.S. PATENT DOCUMENTS

| | | | |
|---|---|---|---|
| 4,475,804 | 10/1984 | Kanno et al. | 355/315 X |
| 4,821,064 | 4/1989 | Mills et al. | 271/313 X |
| 4,870,445 | 9/1989 | Collier et al. | 355/282 |
| 4,965,640 | 10/1990 | Watarai et al. | 355/283 |

FOREIGN PATENT DOCUMENTS

| | | | |
|---|---|---|---|
| 0088735 | 8/1978 | Japan | 355/283 |
| 0190971 | 11/1983 | Japan | 355/290 |
| 0085582 | 4/1988 | Japan | 355/315 |
| 0232375 | 9/1989 | Japan | 355/283 |
| 316779 | 12/1989 | Japan | 355/315 |

*Primary Examiner*—A. T. Grimley
*Assistant Examiner*—J. E. Barlow, Jr.
*Attorney, Agent, or Firm*—Foley & Lardner

[57] ABSTRACT

A fixing device for fixing a developing agent image on a recording medium includes a heat roller and a compression roller for pressing the recording medium against the circumferential surface of the heat roller. A discharge guide for guiding the recording paper passing between the rollers, away from the heat roller is arranged near the heat roller. The discharge guide has an end portion located adjacent to the heat roller, and is positioned by a positioning mechanism so that a predetermined distance is defined between the end portion of the discharge guide and the heat roller. The end portion of the guide is spaced away from the heat roller by spacers made of a relatively soft material. A cleaning element is positioned between the spacers. The spacers and cleaning element are biased against the heat roller by a spring force.

8 Claims, 3 Drawing Sheets

BEST AVAILABLE COPY

IMAGE FIXING MEANS INCLUDING A SHEET SEPARATING DEVICE WHICH PREVENTS WEAR OF THE HEATING ROLLER

BACKGROUND OF THE INVENTION

1. Field of the Invention

The present invention relates to a fixing device for image forming apparatuses such as a copying machine, a laser printer, or the like.

2. Description of the Related Art

In recent years, image forming apparatuses, such as a copying machine, a laser printer, or the like, are made compact, and the fixing device used therein is also made compact.

As a fixing device of this type, a heat roller type fixing device comprising a heat roller for melting and fixing a toner image on a recording member, and a compression roller for pressing the recording medium against the heat roller, are normally used, and a heat roller having a diameter of 30 mm or less has been commercially available.

In a conventional heat roller type fixing device, in order to prevent a recording medium from being wound around the heat roller, the distal ends of a plurality of peeling pawls biased by springs are pressed against the outer circumferential surface of the heat roller, thereby peeling the recording medium from the heat roller.

In the conventional device, a cleaning member for cleaning the outer circumferential surface of the heat roller is fixed to a holder, and is pressed against the outer circumferential surface of the heat roller by a pressing member.

However, when the distal ends of the peeling pawls are pressed against the surface of the heat roller to peel a recording medium from the roller surface, the roller surface is often contaminated by the peeling pawls, or a coating layer formed on the roller surface is worn. For example, when a recording medium is jammed, the surface of the heat roller may be damaged by the peeling pawls. When the roller surface is damaged, it is difficult to maintain a satisfactory fixing operation. Furthermore, when the distal end portions of the peeling pawls are worn upon contact with the heat roller, it is difficult to peel a recording medium from the surface of the heat roller using the peeling pawls.

In the conventional fixing device, the holder and pressing member provided exclusively for bringing the cleaning member into contact with the heat roller are required, resulting in poor assembly efficiency, and an increase in manufacturing cost.

SUMMARY OF THE INVENTION

The present invention has been made to solve the above problems, and has as its object to provide a fixing device which employs a small-diameter heat roller such that the leading end of a recording medium separates slightly from the surface of the heat roller due to stiffness of the recording medium itself, and which can prevent the surface of the heat roller from being contaminated and damaged, and can maintain a stable fixing operation for a long period of time.

It is another object of the present invention to provide a fixing device which can reduce the number of parts and can facilitate assembly efficiency, thus reducing manufacturing cost.

In order to achieve the above object, a fixing device of the present invention comprises: means for fixing a developing agent image by contacting the recording medium; means for separating the recording medium from the fixing means; and means for positioning the separating means, the positioning means having a contact member which is in contact with the separating means so that a predetermined gap is maintained between the fixing means and the separating means.

According to the present invention, the leading end of a recording medium, which separates slightly from the surface of a heat roller of the fixing means due to stiffness of the recording medium, is brought into contact with the separating means and is guided away from the fixing means. In this manner, the recording medium can be prevented from being wound around the heat roller, by the separating means which is arranged in a non-contact state with respect to the fixing means. For this reason, the surface of the heat roller is prevented from being contaminated and damaged, and a stable fixing operation can be maintained for a long period of time. In addition, the separating means can be prevented from being worn, and a recording medium can be stably peeled from the fixing means for a long period of time.

According to the present invention, the fixing device comprises cleaning means contacting with the fixing means to clean it. The cleaning means is supported by the separating means.

With this structure, neither a holder nor a pressing member exclusively used for the cleaning means are required. Therefore, the number of parts can be reduced, and assembly efficiency can be facilitated, thus reducing manufacturing cost.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 to 4 show an image forming apparatus provided with a fixing device according to an embodiment of the present invention, in which FIG. 1 is a sectional view showing the overall image forming apparatus, FIG. 2 is a plan view of the fixing device, FIG. 3 is a sectional view taken along a line III—III in FIG. 2, and FIG. 4 is a sectional view taken along a line IV—IV in FIG. 2.

DETAILED DESCRIPTION OF THE PREFERRED EMBODIMENT

An embodiment of the present invention will be described in detail with reference to the accompanying drawings.

Figure 1:
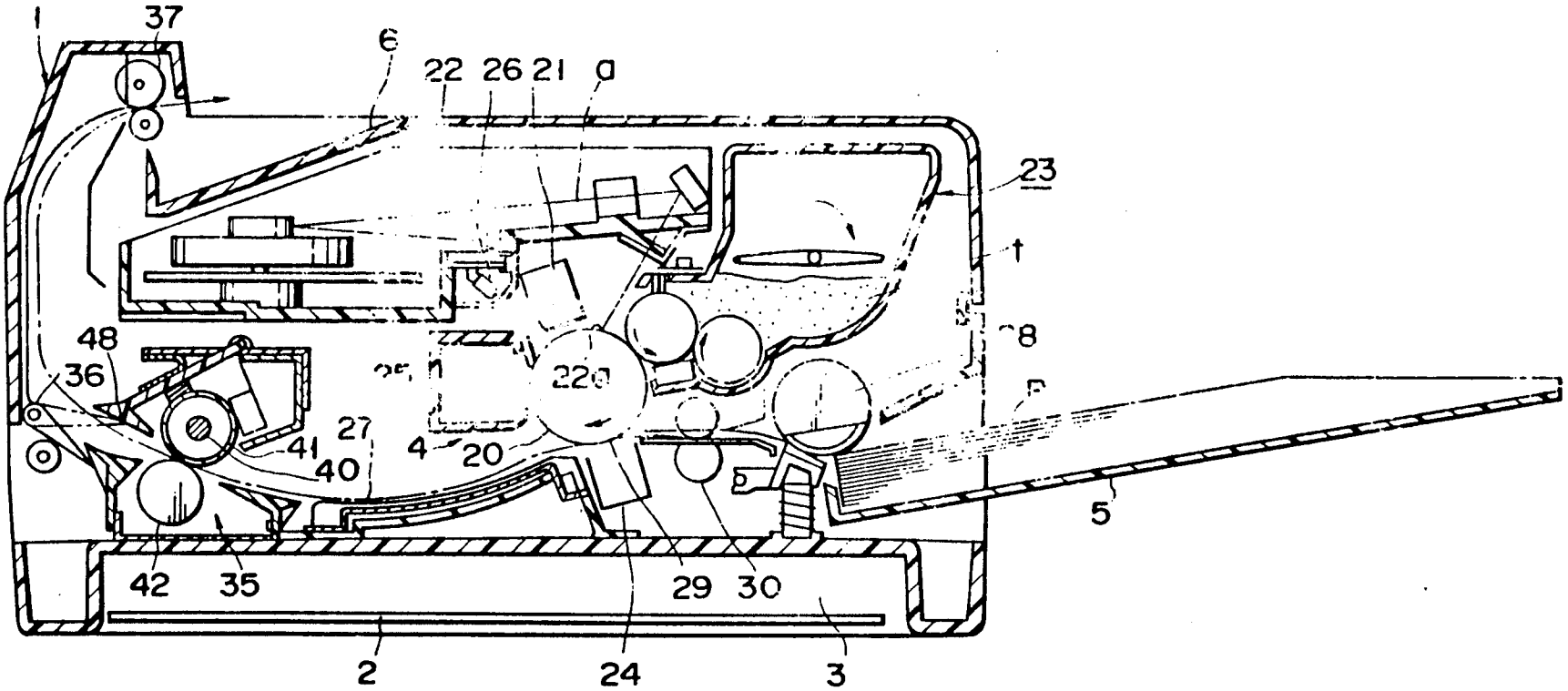

FIG. 1 shows an internal structure of a laser printer which employs a fixing device of the present invention.

The printer comprises an apparatus main body 1. A control board storage portion 3 for storing a plurality of function-addition type control boards (not shown) and a main control board 2 is formed on a bottom portion in the main body 1, and an electrophotographic process unit 4 for forming an image is arranged above the storage portion 3. A paper cassette 5 is loaded in the right side portion of the main body 1, and a discharge portion 6 is formed on an upper portion of the main body 1.

The process unit 4 is constructed or described below.

Unit 4 comprises a photoconductive drum 20 constituting an image carrier. The drum 20 is arranged at a substantially central portion of the unit storage portion in the main body 1. A charger 21 formed of a Scorotron, an exposure portion 22*a* of a laser exposure unit 22 serving as an electrostatic latent image forming means, a developing unit 23, a transfer charger 24 formed of a corotron, a cleaning unit 25, and a pre-exposure device 26 are sequentially arranged around the drum 20 in its rotational direction.

A paper convey path 27 is defined in the apparatus main body 1. A paper sheet P as a recording medium fed from the paper cassette 5 through a paper feed mechanism 28 travels along the convey path 27, and is guided to the discharge portion 6 via an image transfer portion 29 between the lower side of the drum 20 and the upper side of the transfer charger 24.

A pair of aligning rollers 30 are arranged on the upstream side of the image transfer portion 29 with respect to the paper convey path 27. A fixing device 35 (described later), a gate 36 for selecting convey direction, and discharge rollers 37 are arranged on the downstream side of the transfer portion 29.

Figure 2:
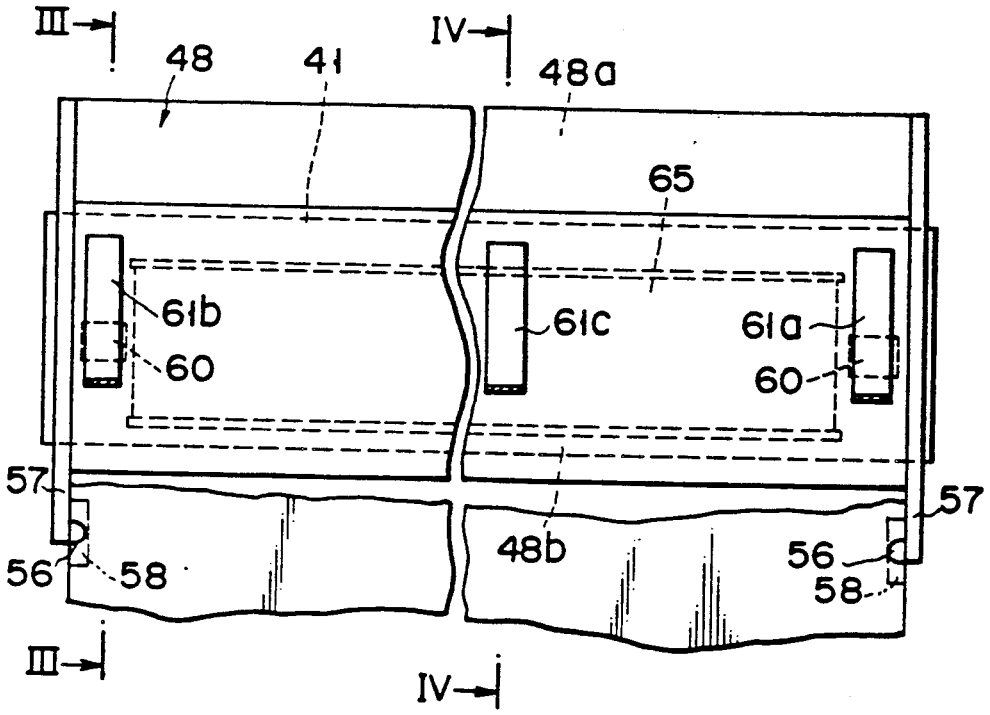
Figure 3:
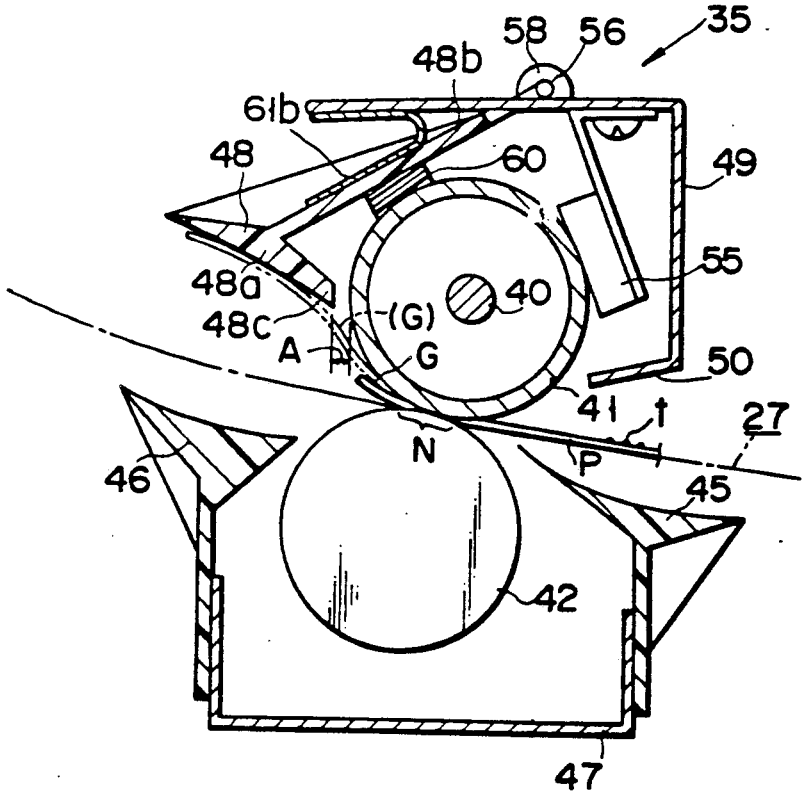
Figure 4:
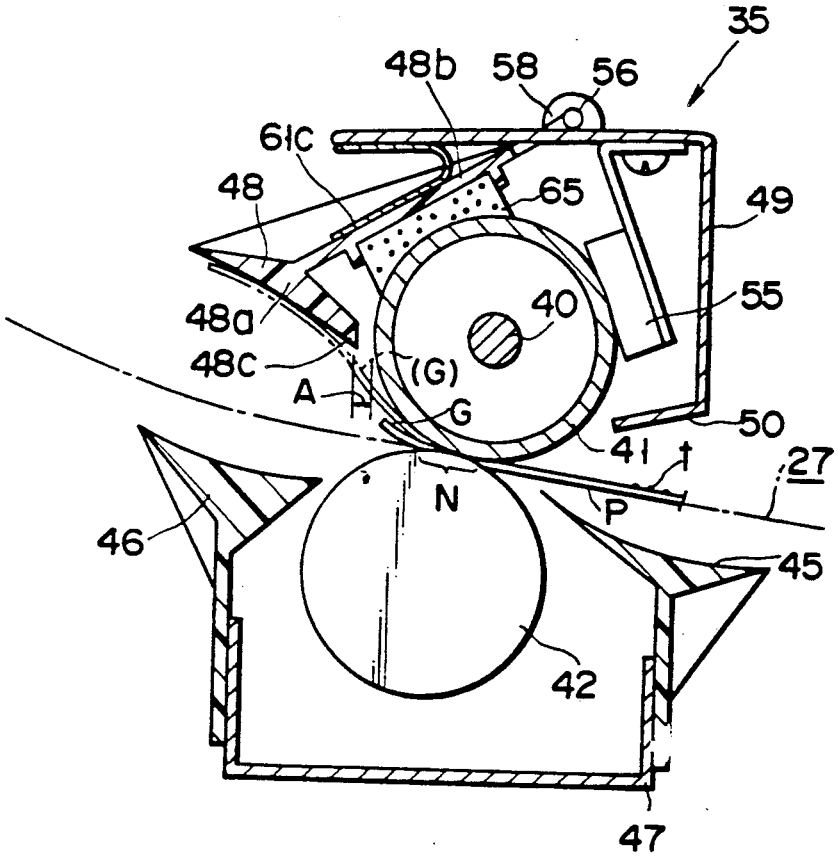

As shown in FIGS. 2 to 4, the fixing device 35 comprises a small-diameter heat roller 41 incorporating a heater lamp 40 and having a diameter of 30 mm or less, and a compression roller 42 which is pressed against the lower side of the heat roller and has substantially the same diameter as that of the roller 41. The heat roller 41 and compression roller 42 serve as fixing means. When a paper sheet P as a recording medium passes between these rollers 41 and 42, a toner image t formed on the paper sheet P is heated, and is melted and fixed on the paper sheet P.

The compression roller 42 is enclosed by a lower casing 47, except for a contact portion with the heat roller 41. An entrance guide 45 and a discharge guide 46 are attached to the lower casing 47. The heat roller 41 is enclosed by an upper casing 49 attached with a discharge guide 48 (described later), except for a contact portion with the roller 42. A portion of the upper casing 49 is bent to form an entrance guide 50. The lower and upper casing 47 and 49 prevent heat inside the fixing device 35 from leaking outside the device, as far as possible.

The fixing device 35 comprises a thermistor 55 serving as a temperature sensor, which is fixed to the upper casing 49 to contact with the outer circumferential surface of the heat roller 41. The thermistor 55 detects the surface temperature of the roller 41. The heater lamp 40 in the heat roller 41 is ON/OFF-controlled according to the detection result of the thermistor 55 so that the surface temperature of the heat roller 41 can be kept at a predetermined temperature necessary for fixing.

The discharge guide 48 serving as separating means comprises a guide plate 48*a* and a support plate 48*b* supporting this guide plate. These plates 48*a* and 48*b* extend in the axial direction of the heat roller 41 over almost the entire length of the roller 41. The support plate 48*b* has a pair of arms 57 extending from the two ends of its upper edge portion, and a projection 56 protecting toward the other arm is formed on the extending end of each arm. These projections 56 are engaged with bearings 58 formed on the upper casing 49. Thus, the discharge guide 48 is rotatable about the projections 56. The guide plate 48*a* has an end portion 48*c* located adjacent to the heat roller 41. The guide plate 48*a* extends from this end portion 48*c* in a direction to separate from the roller 41, and opposes the paper convey path 27. The support plate 48*b* extends from the guide plate 48*a* and is located between the roller 41 and the upper casing 49.

A pair of spacers 60 formed of a resin having high heat and wear resistances, e.g., felt, adhere to the lower surface of the support plate 48*b*, i.e., on the surface opposing the heat roller 41. The spacers 60 are located on two end portions in the longitudinal direction of the support plate. Substantially V-shaped leaf springs 61*a*, 61*b*, and 61*c* as biasing members are arranged on the upper surface of the support plate 48*b* at the two end portions in the longitudinal direction corresponding to the adhered positions of the spacers 60 and the central portion in the longitudinal direction. One arm portion of each leaf spring is fixed to the upper surface of the support plate 48*b* by a screw, and the other arm portion is in contact with the inner surface of the upper casing 49.

Therefore, the discharge guide 48 is biased by the leaf springs 61*a*, 61*b*, and 61*c* toward the heat roller 41, and the spacers 60 are pressed against the outer circumferential surface of the roller 41. Since the spacers 60 are in contact with the outer circumferential surface of the roller 41, the end portion 41*c* of the guide plate 48*a* of the discharge guide 48 is aligned at a position separated from the surface of the roller 41 by a predetermined distance A. The distance A is set to be 0.1 to 5 mm in accordance with the diameter of the heat roller 41.

Note that the biasing force of the pair of leaf springs 61*a* and 61*b* arranged at the two end portions in correspondence with the spacers 60 are set to be larger than that of the leaf spring 61*c* arranged at the central portion. Thus, the spacers 60 as positioning members are satisfactorily pressed against the outer circumferential surface of the heat roller 41, and the distance A between the end portion 48*c* of the guide plate 48*a* and the outer circumferential surface of the roller 41 can be maintained with high precision.

As shown in FIGS. 2 and 4, a cleaning member 65 is adhered on the lower surface of the support plate 48*b* and located between the spacers 60. The cleaning member 65 is pressed against the outer circumferential surface of the heat roller 41 by the biasing force of the leaf springs 61*a*, 61*b*, and 61*c*, thereby cleaning the outer circumferential surface of the roller 41.

When the laser printer with the above structure receives a print start signal from a host system (not shown), the photoconductive drum 20 is rotated, and the outer circumferential surface of the drum 20 is uniformly charged by the charger 21. The exposure unit 22 scans and exposes the outer circumferential surface of the photoconductive drum 20 with a laser beam a modulated upon reception of dot image data from the host system, thereby forming an electrostatic latent image corresponding to the image signal on the surface of the drum 20. The formed latent image is developed by a powder agent (toner) t in the developing unit 23, thus forming a toner image. Residual toner remaining on the drum 20 after the toner image is transferred onto a paper sheet P is removed by the cleaning device 25.

A paper sheet P which is picked up from the paper cassette 5 in synchronism with the toner image forming operation is fed into the main body 1 via the aligning rollers 30. The toner image as a powder image formed on the drum 20 in advance is transferred onto the paper sheet P upon operation of the transfer charger 24. The paper sheet P on which the toner image is transferred is fed into the fixing device 35 along the paper convey path 27. In the fixing device 35, the toner image is melted and fixed on the paper sheet P. Thereafter, the paper sheet P is guided to the discharge rollers 37 via the selector gate 36, and is discharged onto the discharge portion 6.

As shown in FIGS. 3 and 4, in the fixing device 35, the paper sheet P passes through a nip portion N between the small-diameter heat roller 41 and the compression roller 42 and the toner image is melted and fixed onto the paper sheet P. The leading end of the paper sheet P passed through the nip portion N separates slightly from the surface of the heat roller 41 due to its stiffness, as indicated by G in FIGS. 3 and 4. The leading end portion of the paper sheet P floating from the surface of the heat roller 41 is brought into contact with the guide plate 48*a* of the discharge guide 48, which is arranged so that its end portion 48*c* is located adjacent to the heat roller 41, and is guided by the plate 48*a* away from the heat roller 41. In this manner, the paper sheet P can be prevented from being wound around the heat roller 41, by the discharge guide 48 which is arranged in a non-contact state with respect to the heat roller 41.

Residual toner remaining on the outer circumferential surface of the heat roller 41 after the fixing operation is removed by the cleaning member 65.

According to the fixing device with the abovementioned structure for the laser printer, a paper sheet P can be prevented from being wound around the heat roller 41, by the discharge guide 48 which is arranged in a non-contact state with respect to the heat roller 41. Thus, the surface of the heat roller can be prevented from being contaminated and damaged by the guide 48, and a stable fixing operation can be maintained for a long period of time, as compared to a conventional device in which the distal ends of a plurality of peeling pawls are pressed against the heat roller by biasing force of springs to peel a paper sheet P from the heat roller. Since the discharge guide 48 does not contact the heat roller 41, its end portion 48*c* can be prevented from being worn and damaged, so that a paper sheet P can be stably peeled from the heat roller 41 over a long period of time.

The cleaning member 65 is fixed to the discharge guide 48, and is pressed against the heat roller 41 by utilizing the leaf springs 61*a*, 61*b*, and 61*c* for biasing the discharge guide. For this reason, neither a holder nor a pressing member exclusively used for the cleaning member 65 are required, and the number of parts can be reduced. As a result, assembly of the fixing device can be facilitated, and manufacturing cost can be reduced.

The present invention is not limited to the abovementioned embodiment, and various changes and modifications may be made within the spirit and scope of the invention.

For example, in the description of the above embodiment, the spacers 60 are kept in contact with the outer circumferential surface of the heat roller 41 by downward biasing force of the leaf springs 61*a*, 61*b*, and 61*c* to maintain the predetermined distance A between the end portion 48*c* of the discharge guide 48 and the surface of the heat roller 41. Alternatively, the spacers 60 may be kept in contact with the outer circumferential surface of the heat roller 41 by only the weight of the discharge guide 48 without using biasing members. The number of the spacers 60 may be changed if required.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A fixing device for fixing an image on a recording medium, comprising means for fixing the image by contacting the recording medium;

means for separating the recording medium from the fixing means;

means for positioning the separating means, the positioning means having a pair of spacers which are fixed to the separating means and in contact with the fixing means, so that a predetermined gap is maintained between the fixing means and the separating means; and means fixed to the separating means and contacting said fixing means, for cleaning a surface of the fixing means, the cleaning means being arranged between said pair of spacers;

said positioning means including means for biasing the separating means in a direction wherein said pair of spacers and said cleaning means are pressed against said fixing means.

2. A device according to claim 1, wherein said biasing means includes a pair of first biasing members arranged in correspondence with said pair of spacers, and in a second biasing member arranged in correspondence with said cleaning means, said first biasing members having a larger biasing force than does said second biasing member.

3. A device according to claim 1, which further comprises a casing arranged to cover said fixing means, and wherein said separating means has a support portion rotatably supported by said casing and opposing said fixing means, and a paper guide portion fixed to said support portion and having an end portion located adjacent to the fixing means, said paper guide portion extending from said end portion in a direction away from said fixing means.

4. A device according to claim 3, wherein said positioning means includes a spacer fixed to said support position and contacts the fixing means, and means arranged between said support portion and said casing, for biasing said support portion in a direction wherein said spacer is pressed against the fixing means.

5. A device according to claim 4, which further comprises means fixed to said support portion and contacting the fixing means, for cleaning the fixing means.

6. An image forming apparatus, comprising means for forming an image on an image bearing member;

means for transferring the image formed on the image bearing member onto a recording medium;

means for fixing the image by contacting the recording medium;

means for separating the recording medium from the fixing means;

means for positioning the separating means, the positioning means having a pair of spacers which are fixed to the separating means and in contact with the fixing means, so that a predetermined gap is maintained between the fixing means and the separating means; and means fixed to the separating means and contacting said fixing means, for cleaning a surface of the fixing means, the cleaning means being arranged between said pair of spacers;

said positioning means including means for biasing the separating means in a direction wherein said pair of spacers and said cleaning means are pressed against said fixing means.

7. A fixing device for fixing an image on a recording medium, comprising means for fixing the image by contacting the recording medium;

means for separating the recording medium from the fixing means;

means for positioning the separating means, the positioning means having a pair of spacers arranged between the separating means and the fixing means and contacting the fixing means so that a predetermined gap is maintained between the fixing means and the separating means;

means fixed to the separating means and contacting said fixing means, for cleaning a surface of the fixing means, the cleaning means being arranged between said pair of spacers; and means for biasing the separating means in a direction wherein the spacers and the cleaning means are pressed against the fixing means, the biasing means including a pair of first biasing members arranged in correspondence with said pair of spacers, and a second biasing member arranged in correspondence with the cleaning means, the first biasing members having a larger biasing force than that of the second biasing member.

8. A fixing device as in claim 7, wherein the fixing device includes a hot roller, said gap being determined in relationship to the diameter of said hot roller.

* * * * *